US008430030B2

(12) United States Patent
Kautto et al.

(10) Patent No.: US 8,430,030 B2
(45) Date of Patent: Apr. 30, 2013

(54) ARRANGEMENT FOR SUPPORTING SHELL INTO BREECH-LOADING WEAPON BARREL

(75) Inventors: Jussi Kautto, Laitolahdenkatu (FI); Mauri Kuru, Nottbeckinkatu (FI); Pekka Niemi, Pajunevantie (FI); Jukka Tiainen, Kisakatu (FI); Samppa Astikainen, Kaonpäänkatu (FI); Seppo Mahla, Sahurintie (FI)

(73) Assignee: Patria Land Systems Oy, Helsinki (FI)

( * ) Notice: Subject to any disclaimer, the term of this patent is extended or adjusted under 35 U.S.C. 154(b) by 192 days.

(21) Appl. No.: 12/746,964

(22) PCT Filed: Jan. 30, 2009

(86) PCT No.: PCT/FI2009/050079

§ 371 (c)(1), (2), (4) Date: Jul. 23, 2010

(87) PCT Pub. No.: WO2009/095541

PCT Pub. Date: Aug. 6, 2009

(65) Prior Publication Data

US 2010/0288150 A1 Nov. 18, 2010

(30) Foreign Application Priority Data

Jan. 31, 2008 (FI) ..... 20085076

(51) Int. Cl.
*F41F 1/06* (2006.01)

(52) U.S. Cl.
USPC ..... 102/293; 102/483

(58) Field of Classification Search ..... 102/293, 102/372, 349, 353, 373, 445, 469, 498, 529; 89/1.811, 1.806, 1.819; 206/3
See application file for complete search history.

(56) References Cited

U.S. PATENT DOCUMENTS 2,070,946 A * 2/1937 Joyce ..... 102/373
2,210,959 A * 8/1940 Storm ..... 102/373

(Continued)

FOREIGN PATENT DOCUMENTS

FI 108965 B 4/2002
FI 112700 B 12/2003

(Continued)

*Primary Examiner* — Michael Carone
*Assistant Examiner* — Reginald Tillman, Jr.
(74) *Attorney, Agent, or Firm* — Birch, Stewart, Kolasch & Birch, LLP

(57) ABSTRACT

The invention relates to an arrangement for supporting a shell into the barrel of a breech-loading weapon. The arrangement comprises a support piece (6) that is provided with an edge flange (7) and is to be fastened to a tail of the shell. The support piece further comprises a firing mechanism for firing the actual primer of the shell. The arrangement further comprises a connecting means (8) between the support piece (6) and the shell tail (4), the connecting means being arranged to fasten to the shell and to the support piece (6) and thus to fasten the support piece with a mechanical connection to the shell tail (4). The connecting means (8) comprises at least one shank part (9) having a first end and a second end, the first end of the shank part being arranged to fasten to the connecting means (8) and the second end to the shell tail (4). The fastening between the first end of the shank part and the shell is arranged to yield in a firing situation, thus enabling the detachment of the shell from the support piece. The second end of the shank part (9) is arranged to fasten to the shell tail tube (3) and to bend or turn away from the shell tail tube (3) in a firing situation.

10 Claims, 4 Drawing Sheets

U.S. PATENT DOCUMENTS

| | | | | | |
|---|---|---|---|---|---|
| 2,215,075 | A | * | 9/1940 | Weldin | 102/373 |
| 2,368,064 | A | * | 1/1945 | Fanger | 102/483 |
| 2,872,864 | A | * | 2/1959 | Barnes et al. | 102/436 |
| 3,098,447 | A | * | 7/1963 | Hosli | 244/3.23 |
| 3,754,726 | A | * | 8/1973 | Rusbach | 244/3.28 |
| 4,444,115 | A | | 4/1984 | Romer et al. | |
| 4,616,554 | A | * | 10/1986 | Spink et al. | 89/1.806 |
| 5,503,080 | A | | 4/1996 | Goward et al. | |
| 6,257,148 | B1 | | 7/2001 | Toivonen et al. | |
| 6,772,693 | B2 | | 8/2004 | Kuru et al. | |
| 2010/0288112 | A1 | * | 11/2010 | Reunamaki et al. | 89/27.13 |

FOREIGN PATENT DOCUMENTS

| | | | |
|---|---|---|---|
| GB | 1452778 | A | 10/1976 |
| GB | 2260390 | A | 4/1993 |
| WO | WO 2004/003454 | A1 | 1/2004 |

* cited by examiner

Fig. 7
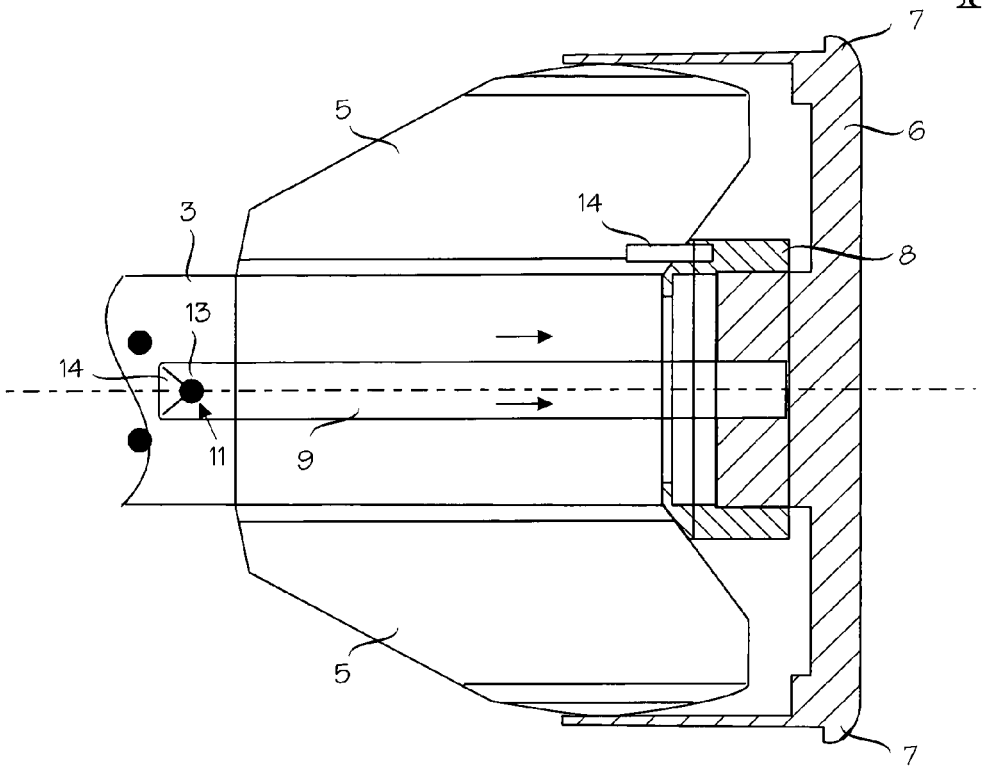
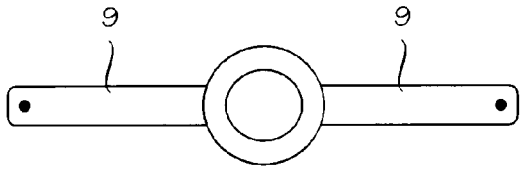
Fig. 8
Fig. 9
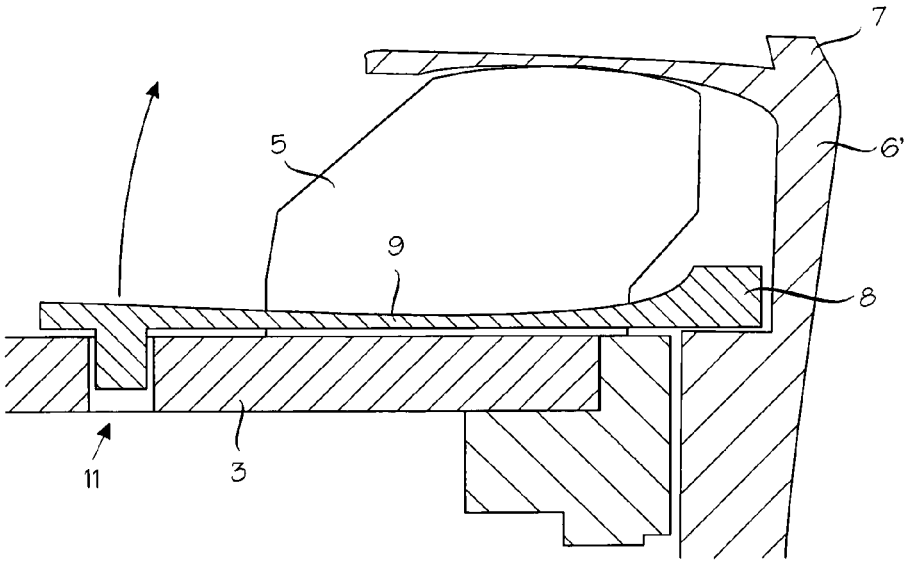

ARRANGEMENT FOR SUPPORTING SHELL INTO BREECH-LOADING WEAPON BARREL

The invention relates to an arrangement for supporting a shell into the barrel of a breech-loading weapon, the arrangement comprising a support piece that is provided with an edge flange and is to be fastened to a tail of the shell, the support piece further comprising a firing mechanism for firing the actual primer of the shell, the arrangement further comprising a connecting means between the support piece and the shell tail, the connecting means being arranged to fasten to the shell and to the support piece and thus to fasten the support piece with a mechanical connection to the shell tail, the connecting means comprising at least one shank part having a first end and a second end, the first end of the shank part being arranged to fasten to the connecting means and the second end to the shell tail, the fastening between the first end of the shank part and the shell being arranged to yield in a firing situation, thus enabling the detachment of the shell from the support piece.

A mortar may be arranged on an appropriate moving base, for instance in an armoured vehicle, whereby the mortar can be moved from one place to another in a preferred manner and, on the other hand, quickly transferred away from an emplacement, for example to a safe place after firing or to a new emplacement.

If a heavy mortar is mounted on a movable base, it is not often easy to mount sufficiently heavy cannon defences on the same base for the purpose of defence, for example. In such a case, it is to be noted that light automatic armament is often insufficient against threats that are farther away, antitank defences, tanks or other artillery, for example.

Due to the above aspects, in some situations, it would be preferable to be able to a use smooth-bore barrel mortar for firing also in the horizontal direction with direct laying, and even downwards. Such firing is not possible with a mortar in a normal situation because the problem is that the mortar shell does not stay in place in the unrifled barrel of the mortar, but may slide forward in the barrel in such a manner that it can no longer be fired.

Various solutions have been provided for solving the above problem. As an example of known solutions, the solution disclosed in U.S. Pat. No. 5,503,080 may be mentioned. In this known solution, a separate guide and fastening piece is used in the tail of the mortar shell. The solution is based on the use of notches dimensioned according to the shell tail, i.e. the shell tail is inserted into the notches, whereby the tail is fastened to the notches by means of a friction connection. A drawback of this solution is that the above-mentioned friction connection does not provide a sufficiently reliable fastening, which results in the reliability of the performance of the shell being insufficient. In this context, it is to be noted that there are always some variations for instance in the dimensions of the guiding fins of a mortar shell that result from the manufacture and cause variation in the friction forces and thereby in the magnitude of the fastening force of the mortar shell.

Various new solutions have been developed for eliminating the disadvantages of the above known solution. Examples of such solutions include the solutions disclosed in Finnish patent publications 108965 and 112700. The solutions of Finnish patent publications 108965 and 112700 have eliminated drawbacks of the operating principle of the solution according to U.S. Pat. No. 5,503,080, and thus a very good reliability has been achieved for a projectile. In the solutions of Finnish publications 108965 and 112700, a threaded connection is used, for example. However, using a threaded connection results is relatively laborious, in other words it is relatively laborious to fit parts together and then rotate one part in relation to another in a manner achieving the required fastening. It is to be noted that in real situations there may often be situations where the users of a mortar or the support persons of mortar users must act extremely quickly. Further, it is to be noted that automation of a threaded connection implementation is not a simple task. A further disadvantage of Finnish patent publication 112700 is that because the shanks fastens to the front surfaces of the guiding fins of the shell, the solution is not optimal for all shell types, i.e. it is possible that the solution does not work in connection with a guiding fin of a given shape.

An object of the invention is to provide an arrangement for supporting a shell into the barrel of a breech-loading weapon, by means of which the drawbacks of the prior art can be eliminated. This is achieved with the arrangement of the invention, which is characterized in that the second end of the shank part is arranged to fasten to the shell tail tube and to bend or turn away from the shell tail tube in a firing situation.

An advantage of the invention is above all that the invention achieves a mechanical connection between the support piece and the shell and, thus, enables the prevention of the movement of the shell in the barrel even if the barrel were turned obliquely downwards, the connection being suitable for as many types of shells as possible. A further advantage of the invention is its simplicity and operational reliability. Still a further advantage is that the invention is well suitable for battling situations wherein different work phases have to take place extremely rapidly in certain situations and yet the connection has to be extremely reliable.

In the following, the invention will be explained with reference to the examples of the figures in the attached drawing, wherein FIGS. 1 to 3 show the principle of a first embodiment of the arrangement of the invention;

FIG. 7 shows the principle of a third embodiment of the arrangement of the invention;

FIG. 8 shows a detail of the arrangement of FIG. 7 as a separate view;

FIG. 9 shows a fourth embodiment of the arrangement of the invention;

Figure 1:
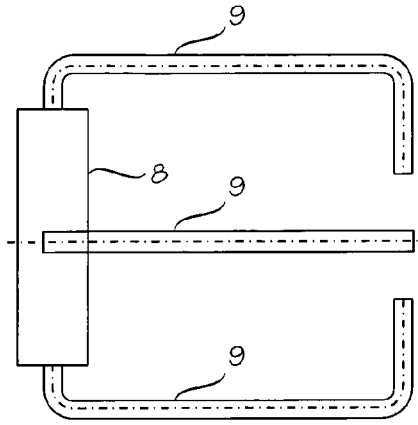
FIGS. 1 to 3 show a first embodiment of the arrangement of the invention.
Figure 2:
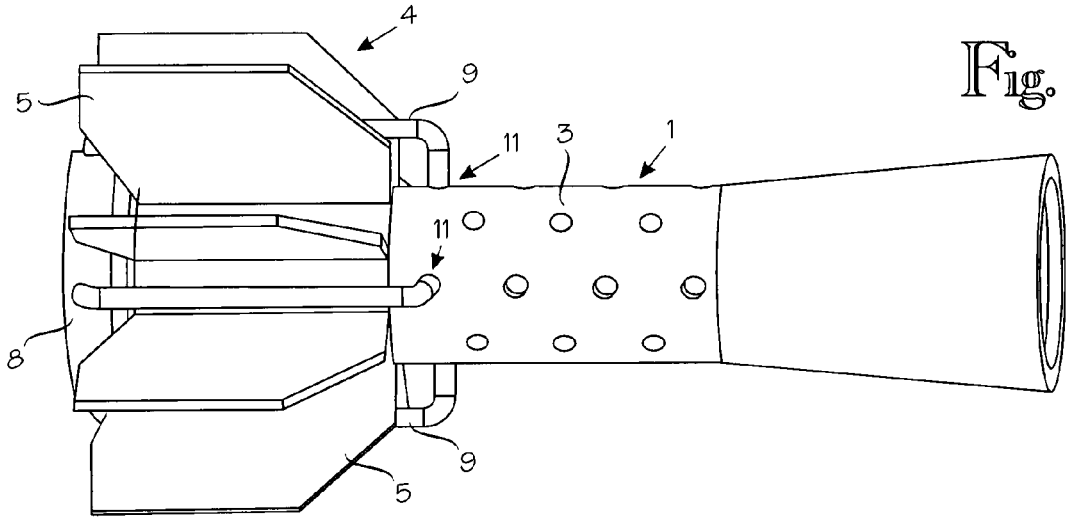
Figure 3:
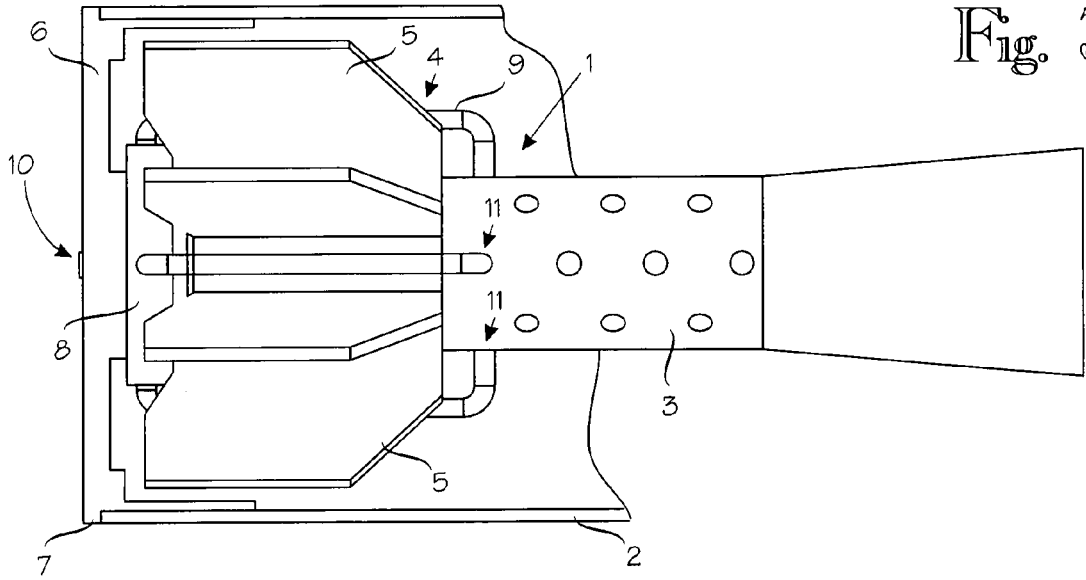

FIGS. 1 to 3 show the principle of a first embodiment of the arrangement of the invention. A shell 1 is arranged in a barrel 2 of a breech-loading weapon. The weapon may be for instance a mortar where the inner surface of the barrel is substantially smooth. The weapon may be placed in an armoured vehicle, for example. The rear part of the shell is provided with a tail tube 3 and a tail 4. The tail 4 comprises one or typically several guiding fins 5 for affecting the trajectory of the shell 1. FIG. 1 shows the shell only by way of principle, and thus it is obvious that the details of the structure of the shell may deviate from the structure of FIG. 1. For the sake of clarity, the breech of the weapon and other details are not shown in the figures.

The above aspects as well as other aspects relating to the details of the shell and the weapon are included in the general expertise of a person skilled in the art, so they are not described in more detail in this context.

In the embodiment of FIGS. 1 to 3, a support piece 6 is fastened to a tail 4 of a shell, the support piece helping to keep the shell 1 in place in the barrel 2 until it is fired. An edge flange 7 in the support piece 6 prevents the shell from moving forward in the barrel 2 when the barrel 2 is oriented horizontally or when the barrel 2 is oriented downwards. The support piece 6 is dimensioned to endure, not only the loads caused by the mass of the shell, but also any forces caused by vibration and accelerations.

In addition to the above-mentioned elements, the embodiment of FIGS. 1 to 3 comprises a connecting means 8 arranged to fasten to both the shell 1 and the support piece 6, thus fastening the support piece 6 by means of a mechanical connection to the shell tail 4 and, further, by means of the edge flange 7, to keep the shell 1 in place in the barrel 2 as was described above.

In the embodiment of FIGS. 1 to 3, the connecting means 8 comprises at least one shank part 9. A first end of the shank part 9 is arranged to fasten to the connecting means 8 and the second end to the shell tail.

The connecting means 8 is mounted in place in the support part by means of a suitable principle. As an example of suitable principles, the use of a threaded connection may be mentioned.

Normally, when shells are fired with a shell mortar, a firing mechanism 10 of the shell mortar generates an impact to the actual primer, as a result of which the propelling charge inside the tail tube 3 is fired, throwing the shell 1 out of the barrel. The firing mechanism 10 of the primer may be any suitable solution. In the present context, reference is made to the principal solution disclosed in Finnish patent publication 108965.

In accordance with an essential idea of the invention, the second end of the shank part 9 is arranged to fasten to the shell tail tube 3 and to bend or turn away from the shell tail tube 3 in a firing situation. In the embodiment of FIGS. 1 to 3, the second end of the shank part 9 is arranged to fasten to a pressure discharge hole 11 in the tail tube 3, the second end being arranged to detach from the pressure discharge hole 11 by the action of pressure and/or gas flow.

In the embodiment of FIGS. 1 to 3, hook-like shank parts are used, i.e. both ends of the shank parts 9 are hook-like in such a manner that the first ends fasten to holes provided in the connecting means, and the second ends correspondingly to the pressure discharge holes 11 of the shell tail tube 3, as is shown in FIG. 3. The number of shank parts may vary completely freely, in the embodiment of FIGS. 1 to 3, four shank parts 9 are used, but there may equally well be also one, two, three etc. shank parts. The shank part may be prepared from a suitable thread-form material, for example. However, this not the only possibility, but different material alternatives and shapes are feasible.

The second end of the shank part 9 is provided in a manner allowing it to settle in the pressure discharge hole 11 smoothly, but, however, sufficiently solidly in order for the contact of the connecting means of the shell to be maintained. The pressure generated by the firing of the charge is directed to the second end of the shank part in the pressure discharge hole, whereby the discharging pressure or/and gas flow forces the second end out of the pressure discharge hole by bending the shank part 9.

Accordingly, the above-described fastening manner is not disposable, but the whole constituted by the connecting means and the shank parts, shown in FIG. 1, may be reused in connection with a new shell.

Figure 4:
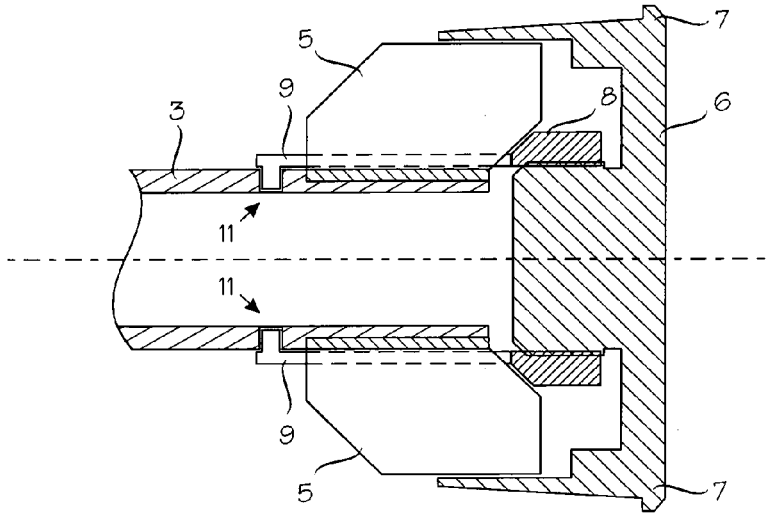
FIG. 4 shows the principle of another embodiment of the arrangement of the invention.

FIG. 4 shows a second embodiment of the arrangement of the invention. In corresponding parts of FIG. 4, the same reference numerals are used as in connection with the embodiment of FIGS. 1 to 3.

The basic principle of the embodiment of FIG. 4 corresponds to the embodiment of FIGS. 1 to 3. In the embodiment of FIG. 4, the second ends of the shank parts 9 fasten to the farthermost pressure discharge holes 11 of the shell tail tube. In this embodiment, the shank parts 9 and the connecting means 8 are provided as an integral part, but they may also be provided as different parts. The flexible, but tensile-strong shank parts extend to the pressure discharge holes and fasten thereto as was described above. The above-mentioned integral part is fastened to the support part 6 by means of a threaded connection, for example. Other connection principles are also feasible.

Upon firing, the gunpowder gas generated from the propelling charge pushes the second end of the shank part 9 out of the pressure discharge hole 11, whereby the shank part 9 bends away from the shell tail tube 3. The second end of the shank part 9 is withdrawn from the pressure discharge hole either by the action of the gas pressure or by the action of the gas flow or by the interaction of both. After the detachment of the shell, the unbroken fastening element is removed from the weapon normally and the parts are reusable according to the possibilities.

Figure 5:
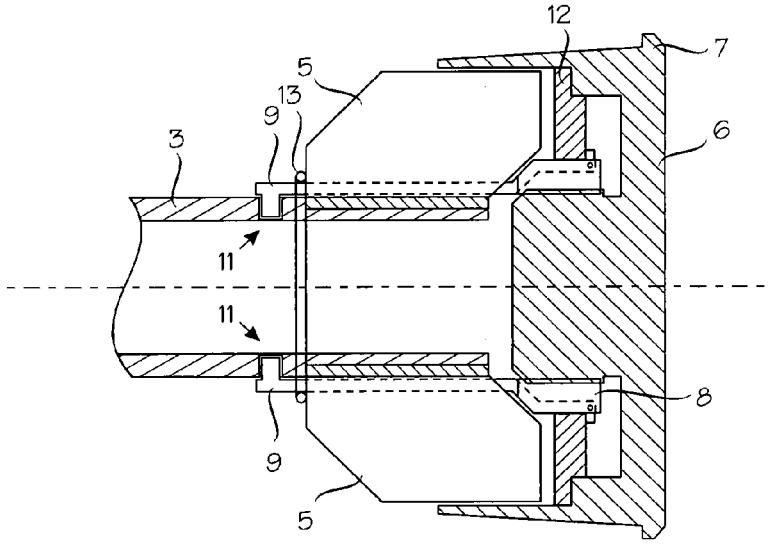
FIGS. 5 and 6 show another type of implementation of the embodiment of FIG. 4.
Figure 6:
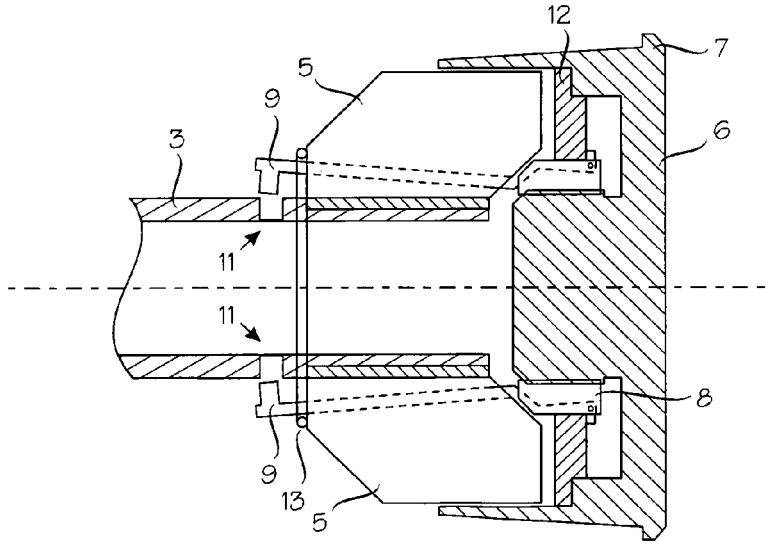

FIGS. 5 and 6 show another type of implementation of the embodiment of FIG. 4. In corresponding parts of FIGS. 5 and 6, the same reference numerals are used as in the previous examples.

In the embodiment of FIGS. 5 and 6, a pressure plate 12 is arranged in connection with the first ends of the shank parts 9. The first ends of the shank parts are articulated to the connecting means 8. By the action of the gas pressure released in a firing situation, a pressure is directed to the pressure plate 12 that generates a force effect in the first end of the shank part 9 that turns the first end of the shank part 9. The above-mentioned force effect is arranged to turn the shank part 9 in a manner opening the fastening between the second end of the shank part 9 and the shell, as is shown in FIG. 8. In this embodiment, the second ends of the shank parts are kept in the fastening position according to FIG. 7 by means of a suitable tightening element 13, an O-ring made from a flexible material, for example. In this embodiment, the first end of the shank part 9 may be arranged to fasten also elsewhere than to the pressure discharge hole 11. The tail tube 3 may be provided with a suitable recess or groove, for example, to which the second end of the shank part fastens, etc.

FIGS. 7 and 8 show a third embodiment of the arrangement of the invention. In corresponding parts of FIGS. 7 and 8, the same reference numerals are used as in the previous examples.

In the embodiment of FIGS. 7 and 8, the shank parts 9 are provided from a separate draw strip part shown in FIG. 8. The draw strip part is an integral piece whose shank parts are folded forward in an operating situation, as is shown in FIG. 7.

The draw strip part is made from a metal material or another suitable material, for example, that endures handling and the charging impact. The ends of the shank parts of the draw strip part are provided with a suitable member 13 by means of which the shank part 9 is arranged to fasten to the pressure discharge hole 11 of the shell, as is shown in FIG. 7.

The draw strip part is arranged to cooperate with a draw nut part serving as the connecting means 8. The strip part is not fastened to the draw nut part, but is only arranged to cooperate with the draw nut. The draw nut part controls the support piece 6 first to the threads thereof and, when the sleeve part of the support piece encounters the base of the shell, tends to move backwards by the action of the threads and thus pulls the sleeve part and the tail towards one another by means of the draw strips. A restraining pin 14 prevents the draw nut part from rotating along with the support part 6 during the tightening.

In principle, the embodiment of FIGS. 7 and 8 may be applied in the same way as the embodiment of FIGS. 5 and 6, i.e. the shank parts 9 are kept in a locked position by means of an O-ring, for example, as shown in FIGS. 5 and 6. The pressure released in a firing situation bends the shank parts outwards, whereby the connection opens, as is shown in FIGS. 5 and 6, etc.

However, in connection with the embodiment of FIGS. 7 and 8, it has been found to be particularly preferable to use a pop rivet, thus serving as member 13, as the fastening member at the ends of the shank parts. A pop rivet fastens the draw strip part to the pressure discharge hole. The pop rivet must not touch the shell tube. The draw strip part is dimensioned in a manner making it break in a firing situation. The draw strip part is arranged to break in a firing situation in the area of the draw strip part at the front side of the pop rivet. The above-mentioned preferred breaking point is shown in FIG. 7 by means of reference numeral 14.

FIG. 9 shows the principle of a fourth embodiment of the arrangement of the invention. In corresponding parts of FIG. 9, the same reference numerals are used as in the examples of the previous figures.

In the embodiment of FIG. 9, the support part 6 fastens to the pressure discharge holes in the shell tail tube with two or more shank parts 9. The pins of the second end of the shank parts 9 fasten to the pressure discharge holes 11. The gas pressure generated in a firing situation bends the shank parts 9 outwards, and the shell is released. In the examples of FIG. 9, the shank parts 9 and the connecting means 8 are provided as an integral piece fastened to the support part 6 by means of a threaded connection, for example. Another kind of fastening method is also naturally feasible.

Figure 12:
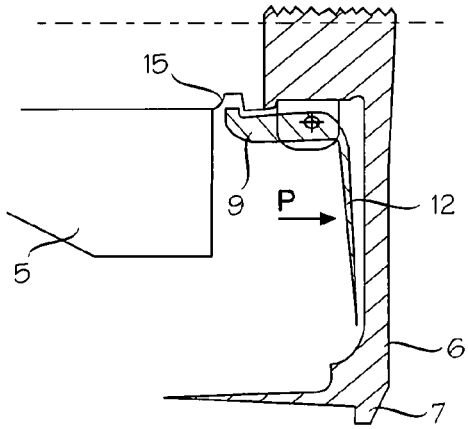
FIG. 12 shows another type of implementation of the embodiment of FIGS. 10 and 11.

As was mentioned above, the pressure discharge holes 11 of the tail tube 3 are not the only fastening points. In accordance with the basic idea of the invention, the second end of the shank part 9 may also be arranged to fasten to a mating surface at the end of the tail tube 3 or to a flange at the end of the tail tube, whereby the shank part 9 is arranged to bend or turn in a firing situation in a manner making the second end of the shank part detach from the mating surface. Reference was made to such a solution already in connection with the embodiment of FIGS. 5 and 6, for example. FIG. 12 shows the principle of an embodiment, wherein the second ends of the shank parts 9 are arranged to fasten to a mating surface 15 at the end of the tail tube or a flange at the end of the tail tube. The mating surface may be any suitable surface, a groove or a recess, for example.

In the embodiment of FIG. 12, the shank parts 9 are articulated to the connecting means 8. In connection with the first end of the shank part is arranged a pressure plate 12 to which a force effect is directed by the action of gas released in the firing situation, the force effect turning the shank parts in a manner opening the fastening between the second ends of the shank parts and the shell. The pressure plate 12 may be for instance a round plate part provided with a middle hole receiving pressure from all sides. The pressure effect is denoted with arrow P in FIG. 12. In the example of FIG. 12, the pressure plate is arranged as an integral part with the shank part 9. However, this is not the only option, but the pressure plate may also be provided as a separate part with respect to the shank part, as was brought forth in connection with FIGS. 5 and 6.

Figure 10:
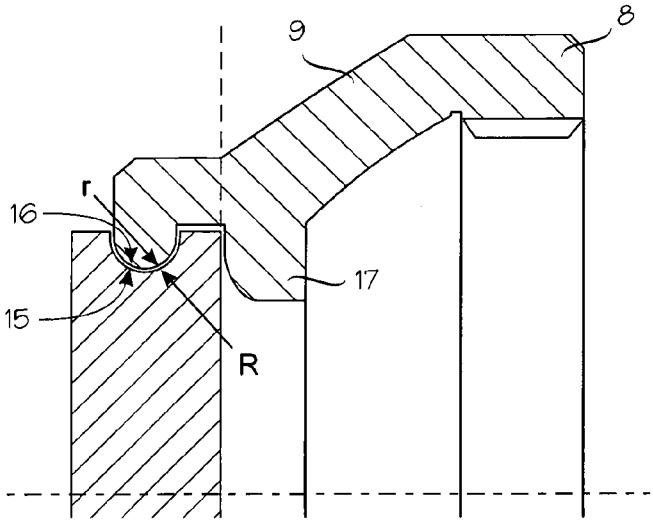
FIGS. 10 and 11 show the principle of a fifth embodiment of the arrangement of the invention.
Figure 11:
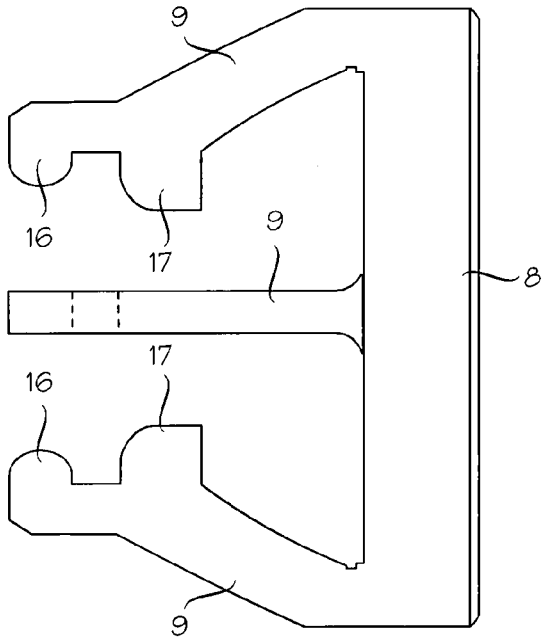

FIGS. 10 and 11 show still another embodiment of the invention. In corresponding parts of FIGS. 10 and 11, the same reference numerals are used as in the other examples.

In the embodiment of FIGS. 10 and 11, the second ends of the shank parts 9 fasten to a mating surface 15 of the end of the tail tube or of a flange at the end of the tail tube. In this embodiment, the second ends of the shank parts 9 are provided with a fastening part 16 and a retaining part 17. The radius r of the fastening part is preferably arranged smaller than the radius R of the groove serving as the mating surface 15. The retaining surface 17 prevents the shank parts 9 from being pushed too far. It is obvious that the retaining part 17 is not necessary, but the task of the retaining part 17 may also be replaced with an intermediate firing pin assembly, for example.

The fastening part 16 may be constructed freely, it is possible to construct it for example by arranging a ball or a ball-like protrusion at the end of the shank part 9, the protrusion settling in a groove in the flange of the shell. The inner diameter of the groove is preferably the same or only slightly larger than the ball surface of the second end of the shank part 9. The shank parts 9 bend without breaking to the same extent as the ball surface swists the shank part when the structure is pressed to the shell. It is to be noted that the shank parts 9 may also be spring-loaded parts, for example, whereby they do not bend, but turn against the loading of the spring when the structure is pressed to the shell. There are preferably at least three shank parts 9 to ensure an even fastening and to prevent the swinging of the support piece 6. However, there may be also less than three shank parts and, naturally also more than three.

The above-described application examples are in no way intended to restrict the invention; instead, the various details of the invention may be varied fully freely within the scope of the claims. For example, the number of shank parts may vary according to the need in each particular case, etc.

The invention claimed is:

1. An arrangement for supporting a shell into the barrel of a breech-loading mortar weapon, the arrangement comprising:

a support piece that is provided with an edge flange and is configured to be fastened to a tail of the shell, the support piece further comprising a firing mechanism for firing the actual primer of the shell, a connector between the support piece and the shell tail, the connector configured to be fastened to the shell and to the support piece and thus to fasten the support piece with a mechanical connection to the shell tail, at least one shank part having a first end and a second end, the first end of the shank part being configured to be fastened to the connector and the second end to the shell tail, the fastening between the first end of the shank part and the shell being arranged to yield in a firing situation, thus enabling the detachment of the shell from the support piece, whereby the second end of the shank part is configured to be fastened to a shell tail tube and configured to bend or turn away from the shell tail tube in a firing situation, the second end of the shank part being fastened to a pressure discharge hole in the tail tube, and the second end being arranged to detach from the pressure discharge hole by the action of pressure and/or gas flow.

2. An arrangement as claimed in claim 1, wherein the arrangement comprises a separate draw strip part comprising two shank parts and a draw nut part, the draw nut part being fastened to the support piece, and the second ends of the shank parts of the draw strip part configured to be fastened to the shell, the draw strip part being functionally connected to the draw nut part.

3. An arrangement as claimed in claim 2, wherein the draw strip part is provided as an integral part whose shank parts are configured to be fastened to opposite sides of the shell tail tube.

4. An arrangement as claimed in claim 1, the shank part is provided as an integral part of the connector.

5. An arrangement as claimed in claim 1, wherein in connection with the first end of the shank part is arranged a pressure plate, which is arranged to direct a force effect to the first end of the shank part for turning the shank part by the action of the pressure released in a firing situation, the force effect being arranged to turn the shank part in a manner opening the fastening between the second end of the shank part and the shell.

6. An arrangement as claimed in claim 5, wherein the pressure plate is arranged as a substantially round plate inside the support piece.

7. An arrangement as claimed in claim 5, wherein the pressure plate is arranged as an integral part of the shank part.

8. An arrangement as claimed in claim 5, wherein the pressure plate is arranged as a separate part with respect to the shank part.

9. An arrangement as claimed in claim 3, wherein a pop rivet is fastened to the second ends of the shank parts of the draw strip part, the pop rivet being configured to fasten the shank parts to the shell, and the draw strip part is arranged to break in a firing situation.

10. An arrangement as claimed in claim 9, wherein the draw strip part is arranged to break in a firing situation in an area of the draw strip part on the front side of the pop rivet.

* * * * *